US011639802B2

(12) United States Patent
Liu et al.

(10) Patent No.: US 11,639,802 B2
(45) Date of Patent: May 2, 2023

(54) CONTROL METHOD AND DEVICE OF AIR CONDITIONING SYSTEM AND AIR CONDITIONING SYSTEM

(71) Applicant: Gree Electric Appliances, Inc. of Zhuhai, Guangdong (CN)

(72) Inventors: Hua Liu, Guangdong (CN); Yuhai Su, Guangdong (CN); Shiqiang Zhang, Guangdong (CN); Lianfa Wu, Guangdong (CN); Tao Feng, Guangdong (CN); Peng Cao, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 92 days.

(21) Appl. No.: 17/056,133

(22) PCT Filed: Dec. 14, 2018

(86) PCT No.: PCT/CN2018/120997
§ 371 (c)(1),
(2) Date: Nov. 17, 2020

(87) PCT Pub. No.: WO2020/000922
PCT Pub. Date: Jan. 2, 2020

(65) Prior Publication Data

US 2021/0222900 A1 Jul. 22, 2021

(30) Foreign Application Priority Data

Jun. 28, 2018 (CN) ..... 201810694920.6

(51) Int. Cl.
*F24F 11/30* (2018.01)
*F24F 11/65* (2018.01)
(Continued)

(52) U.S. Cl.
CPC ..... *F24F 11/30* (2018.01); *F24F 11/65* (2018.01); *F24F 11/64* (2018.01); *F24F 11/70* (2018.01);
(Continued)

(58) Field of Classification Search
CPC .. F24F 11/30; F24F 11/65; F24F 11/64; F24F 2140/12; F24F 11/70; F24F 2110/10;
(Continued)

(56) References Cited

U.S. PATENT DOCUMENTS 4,926,652 A * 5/1990 Kitamoto ..... F25B 5/02 62/175
6,109,533 A 8/2000 Ao et al.
(Continued)

FOREIGN PATENT DOCUMENTS

CN 100359254 C 1/2008
CN 105299827 A 2/2016
(Continued)

OTHER PUBLICATIONS

Li, Y., 2015. Variable frequency drive applications in HVAC systems. New Applications of Electric Drives, pp. 167-185. (Year: 2015).*

*Primary Examiner* — Alicia M. Choi
(74) *Attorney, Agent, or Firm* — The Webb Law Firm

(57) ABSTRACT

The present disclosure relates to a control method and a control device of an air conditioning system, and an air conditioning system, and relates to the technical field of air conditioners: the method includes: determining whether piping length compensation is required; if the piping length compensation is required, acquiring one or more metric parameters; and determining a compensation value accord-
(Continued)

ing to the one or more metric parameters, and adjusting an operating state of the air conditioning system according to the compensation value.

15 Claims, 3 Drawing Sheets

(51) Int. Cl.

| | |
|---|---|
| *F24F 11/64* | (2018.01) |
| *F24F 140/12* | (2018.01) |
| *F24F 11/70* | (2018.01) |
| *F24F 110/10* | (2018.01) |
| *F25B 49/02* | (2006.01) |

(52) U.S. Cl.
CPC ..... *F24F 2110/10* (2018.01); *F24F 2140/12* (2018.01); *F25B 49/022* (2013.01); *F25B 2700/1933* (2013.01)

(58) Field of Classification Search
CPC ..... F25B 49/022; F25B 2700/1933; F25B 13/00; F25B 49/02
See application file for complete search history.

(56) References Cited

U.S. PATENT DOCUMENTS

| | | | | |
|---|---|---|---|---|
| 6,766,653 | B2 | 7/2004 | Hong | |
| 11,137,157 | B2 * | 10/2021 | Xu | F24F 11/49 |
| 2004/0255601 | A1 * | 12/2004 | Kwon | F24F 11/30 62/157 |
| 2011/0107781 | A1 * | 5/2011 | Kinugasa | F24F 11/83 62/157 |
| 2012/0125558 | A1 * | 5/2012 | Nortman | F24F 11/30 73/204.25 |
| 2014/0012543 | A1 * | 1/2014 | Son | F24F 11/49 702/185 |
| 2015/0292763 | A1 * | 10/2015 | Jung | F24F 11/30 700/276 |
| 2019/0113244 | A1 * | 4/2019 | Akaiwa | F25B 41/45 |
| 2019/0293417 | A1 * | 9/2019 | Yamada | G01B 21/10 |
| 2020/0080757 | A1 * | 3/2020 | Suzuki | F25B 41/22 |
| 2020/0400340 | A1 * | 12/2020 | Takenaka | F25B 25/005 |

FOREIGN PATENT DOCUMENTS

| | | | | |
|---|---|---|---|---|
| CN | 106247676 | A | | 12/2016 |
| CN | 106610083 | A | * | 5/2017 |
| CN | 108870633 | A | | 11/2018 |
| EP | 1371913 | A1 | | 12/2003 |
| JP | H11344275 | A | | 12/1999 |
| JP | 3028008 | B2 | * | 4/2000 |
| JP | 2003028517 | A | | 1/2003 |
| JP | 2006029602 | A | * | 2/2006 |
| JP | 2006250440 | A | | 9/2006 |
| JP | 201617729 | A | | 2/2016 |
| KR | 100565995 | B1 | * | 3/2006 |
| WO | 2007125959 | A1 | | 11/2007 |

* cited by examiner

CONTROL METHOD AND DEVICE OF AIR CONDITIONING SYSTEM AND AIR CONDITIONING SYSTEM

CROSS-REFERENCE TO RELATED APPLICATIONS

This application is the Unites States national phase of International Application No. PCT/CN2018/120997 filed Dec. 14, 2018, and claims priority to Chinese Patent Application No. 201810694920.6 filed Jun. 28, 2018, the disclosures of which are hereby incorporated by reference in their entirety.

BACKGROUND OF THE INVENTION

Field of the Invention

The present disclosure relates to the technical field of air conditioners, and in particular to a control method of an air conditioning system, a device of an air conditioning system, an air conditioning system and a non-transitory computer readable storage medium.

Description of Related Art

In the use of air-conditioning products, multi-connected air-conditioning systems are increasingly widely used. The multi-connected air conditioner system adopts an outdoor unit to connect two or more indoor units through piping, so as to achieve the purpose of controlling a plurality of indoor temperatures. The multi-connected air-conditioning system relies on the compressor to provide power, and transports a refrigerant to the end of the room through the piping between the indoor units and the outdoor unit to provide cold or heat to the room.

In the related technology, a general multi-connected air-conditioning system determines a capacity demand and a low pressure condition of the system according to a load condition, thereby controlling an actual operating frequency of the compressor.

SUMMARY OF THE INVENTION

According to some embodiments of the present disclosure, there is provided a control method of an air conditioning system, comprising: determining whether piping length compensation is required; acquiring one or more metric parameters, if the piping length compensation is required; and determining a compensation value according to the one or more metric parameters, and adjusting an operating state of the air conditioning system according to the compensation value.

In some embodiments, the determining whether piping length compensation is required comprises: acquiring one or more operating parameters, the one or more operating parameters comprising at least one of: indoor unit operating parameters, outdoor unit operating parameters or environmental parameters; and determining whether the piping length compensation is required according to the one or more operating parameters.

In some embodiments, when the air conditioning system is a multi-connected air conditioning system, the indoor unit operating parameters comprise: a ratio of the number of indoor units that are turned on.

In some embodiments, the outdoor unit of the air conditioning system comprises a compressor, and the outdoor unit operating parameters comprise: a continuous operating time of the compressor since it is started.

In some embodiments, the environmental parameters comprise: a temperature difference between an outdoor temperature value and a temperature value set by an indoor unit.

In some embodiments, the determining whether piping length compensation is required according to the one or more operating parameters comprises determining that the piping length compensation is required under at least one of the following conditions: the one or more operating parameters comprise a ratio of the number of indoor units that are turned on, which is smaller than a preset ratio threshold; the one or more operating parameters comprise a continuous operating time of a compressor since it is started, which is greater than a preset time threshold; or the one or more operating parameters comprise a temperature difference value between an outdoor temperature value and a temperature value set by an indoor unit, which is smaller than a preset temperature difference threshold.

In some embodiments, the determining whether piping length compensation is required according to the one or more operating parameters comprises: determining a partial load of the air conditioning system according to the ratio of the indoor units that are turned on and the temperature difference value; and determining that the piping length compensation is required under the condition that the partial load is smaller than a load threshold and the continuous operating time is larger than the time threshold.

In some embodiments, when the operating state is an operating frequency of the compressor, the acquiring the one or more metric parameter comprises: acquiring an inlet temperature value of an indoor unit; and acquiring a suction pressure of the compressor.

In some embodiments, the determining a compensation value according to the one or more metric parameters comprises: calculating an average temperature value according to the inlet temperature value, when the number of indoor units that are turned on is multiple; calculating an average low pressure according to the suction pressure of the compressor; calculating a difference value between the average temperature value and a saturation temperature corresponding to the average low pressure; and determining the compensation value based on the difference value.

In some embodiments, the larger the difference value, the larger an absolute value of the compensation value, a sign of the compensation value is determined according to an operation mode of an air conditioner.

In some embodiments, the compensation value is a negative value, if the operation mode of the air conditioner is a cooling mode; or, the compensation value is a positive value, if the operation mode of the air conditioner is a heating mode.

According to other embodiments of the present disclosure, there is provided a control device of an air conditioning system, comprising: a determination module for determining whether piping length compensation is required; a detection module for acquiring one or more metric parameters when the piping length compensation is required; and an execution module for determining a compensation value according to the one or more metric parameters and adjusting an operating state of the air conditioning system according to the compensation value.

In some embodiments, the determination module is used for: acquiring one or more operating parameters, the one or more operating parameters comprising at least one of indoor unit operating parameters, outdoor unit operating parameters and environmental parameters; and determining whether the piping length compensation is required according to the one or more operating parameters.

In some embodiments, when the air conditioning system is a multi-connected air conditioning system, the indoor unit operating parameters comprise a ratio of the number of indoor units that are turned on.

In some embodiments, the outdoor unit of the air conditioning system comprises a compressor, and the outdoor unit operating parameters comprise a continuous operating time of the compressor since it is started.

In some embodiments, the environmental parameters comprise a temperature difference between an outdoor temperature value and a temperature value set by an indoor unit.

In some embodiments, the determining whether piping length compensation is required according to the one or more operating parameters comprises determining that the piping length compensation is required under at least one of the following conditions: the one or more operating parameters comprise a ratio of the number of indoor units that are turned on, which is smaller than a preset ratio threshold; the one or more operating parameters comprise a continuous operating time of a compressor since it is started, which is greater than a preset time threshold; or the one or more operating parameters comprise a temperature difference value between an outdoor temperature value and a temperature value set by an indoor unit, which is smaller than a preset temperature difference threshold.

In some embodiments, the determination module determines a partial load of the air conditioning system according to the ratio of the indoor units that are turned on and the temperature difference value; and the determination module determines that the piping length compensation is required under the condition that the partial load is smaller than a load threshold and the continuous operating time is larger than the time threshold.

In some embodiments, when the operating state is an operating frequency of the compressor, the detection module is used for: acquiring an inlet temperature value of an indoor unit; and acquiring a suction pressure of the compressor.

In some embodiments, when determining a compensation value according to the one or more metric parameters, the execution module is used for: when the number of indoor units that are turned on is multiple, calculating an average temperature value according to the inlet temperature value; calculating an average low pressure according to the suction pressure of the compressor; calculating a difference value between the average temperature value and a saturation temperature corresponding to the average low pressure; and determining the compensation value based on the difference value.

In some embodiments, the larger the difference value, the larger an absolute value of the compensation value, a sign of the compensation value is determined according to an operation mode of an air conditioner.

In some embodiments, the compensation value is a negative value, if the operation mode of the air conditioner is a cooling mode; or, the compensation value is a positive value, if the operation mode of the air conditioner is a heating mode.

According to further embodiments of the present disclosure, there is provided an air conditioning system, which is a multi-connected air conditioning system, comprising: a control device, the control device at least comprising the following three modules: a determination module for determining whether piping length compensation is required; a detection module for acquiring one or more metric parameters when the piping length compensation is required; and an execution module for determining a compensation value according to the one or more metric parameter and adjusting an operating state of the air conditioning system according to the compensation value.

In some embodiments, the air conditioning system comprises: the control device of the air conditioning system in any of the above embodiments.

In some embodiments, the determining whether piping length compensation is required comprises: acquiring one or more operating parameters, the one or more operating parameters comprising at least one of indoor unit operating parameters, outdoor unit operating parameters and environmental parameters; and determining whether the piping length compensation is required according to the one or more operating parameters.

In some embodiments, when the air conditioning system is a multi-connected air conditioning system, the indoor unit operating parameters comprise a ratio of the number of indoor units that are turned on.

In some embodiments, the outdoor unit of the air conditioning system comprises a compressor, and the outdoor unit operating parameters comprise a continuous operating time of the compressor since it is started.

In some embodiments, the environmental parameters comprise a temperature difference between an outdoor temperature value and a temperature value set by an indoor unit.

In some embodiments, the determining whether piping length compensation is required according to the one or more operating parameters comprises determining that the piping length compensation is required under at least one of the following conditions: the one or more operating parameters comprise a ratio of the number of indoor units that are turned on, which is smaller than a preset ratio threshold; the one or more operating parameters comprise a continuous operating time of a compressor since it is started, which is greater than a preset time threshold; or the one or more operating parameters comprise a temperature difference value between an outdoor temperature value and a temperature value set by an indoor unit, which is smaller than a preset temperature difference threshold.

In some embodiments, the determining whether piping length compensation is required according to the one or more operating parameters comprises: determining a partial load of the air conditioning system according to the ratio of the indoor units that are turned on and the temperature difference value; and determining that the piping length compensation is required under the condition that the partial load is smaller than a load threshold and the continuous operating time is larger than the time threshold.

In some embodiments, when the operating state is an operating frequency of the compressor, the acquiring the one or more metric parameters comprises: acquiring an inlet temperature value of an indoor unit; and acquiring a suction pressure of the compressor.

In some embodiments, the determining a compensation value according to the one or more metric parameters comprises: when the number of indoor units that are turned on is multiple, calculating an average temperature value according to the inlet temperature value; calculating an average low pressure according to the suction pressure of the compressor; calculating a difference value between the average temperature value and a saturation temperature corresponding to the average low pressure; and determining the compensation value based on the difference value.

In some embodiments, the larger the difference value, the larger an absolute value of the compensation value, a sign of the compensation value is determined according to an operation mode of an air conditioner.

In some embodiments, if the operation mode of the air conditioner is a cooling mode, the compensation value is a negative value; or, if the operation mode of the air conditioner is a heating mode, the compensation value is a positive value.

According to still further embodiments of the present disclosure, there is provided a control device of an air conditioning system, comprising: a processor; a memory for storing processor-executable instructions; wherein the processor is configured to: determine whether piping length compensation is required; if the piping length compensation is required, acquire one or more metric parameters; and determine a compensation value according to the one or more metric parameters, and adjust an operating state of the air conditioning system according to the compensation value.

In some embodiments, the processor is configured to perform the control method of the air conditioning system in any of the above embodiments.

In some embodiments, the determining whether piping length compensation is required comprises: acquiring one or more operating parameters, the one or more operating parameters comprising at least one of indoor unit operating parameters, outdoor unit operating parameters and environmental parameters; and determining whether the piping length compensation is required according to the one or more operating parameters.

In some embodiments, when the air conditioning system is a multi-connected air conditioning system, the indoor unit operating parameters comprise a ratio of the number of indoor units that are turned on.

In some embodiments, the outdoor unit of the air conditioning system comprises a compressor, and the outdoor unit operating parameters comprise a continuous operating time of the compressor since it is started.

In some embodiments, the environmental parameters comprise a temperature difference between an outdoor temperature value and a temperature value set by an indoor unit.

In some embodiments, the determining whether piping length compensation is required according to the one or more operating parameters comprises determining that the piping length compensation is required under at least one of the following conditions: the one or more operating parameters comprise a ratio of the number of indoor units that are turned on, which is smaller than a preset ratio threshold; the one or more operating parameters comprise a continuous operating time of a compressor since it is started, which is greater than a preset time threshold; or the one or more operating parameters comprise a temperature difference value between an outdoor temperature value and a temperature value set by an indoor unit, which is smaller than a preset temperature difference threshold.

In some embodiments, the determining whether piping length compensation is required according to the one or more operating parameters comprises: determining a partial load of the air conditioning system according to the ratio of the indoor units that are turned on and the temperature difference value; and determining that the piping length compensation is required under the condition that the partial load is smaller than a load threshold and the continuous operating time is larger than the time threshold.

In some embodiments, when the operating state is an operating frequency of the compressor, the acquiring the one or more metric parameter comprises: acquiring an inlet temperature value of an indoor unit; and acquiring a suction pressure of the compressor.

In some embodiments, the determining a compensation value according to the one or more metric parameter comprises: when the number of indoor units that are turned on is multiple, calculating an average temperature value according to the inlet temperature value; calculating an average low pressure according to the suction pressure of the compressor; calculating a difference value between the average temperature value and a saturation temperature corresponding to the average low pressure; and determining the compensation value based on the difference value.

In some embodiments, the larger the difference value, the larger an absolute value of the compensation value, a sign of the compensation value is determined according to an operation mode of an air conditioner.

In some embodiments, if the operation mode of the air conditioner is a cooling mode, the compensation value is a negative value; or, if the operation mode of the air conditioner is a heating mode, the compensation value is a positive value.

According to still further embodiments of the present disclosure, there is provided a non-transitory computer readable storage medium having stored thereon a computer program which, when executed by a processor, implements the control method of the air conditioning system as described in any of the above embodiments.

Other features and advantages of the present disclosure will become clear through detailed descriptions of the illustrative embodiments of the present disclosure with reference to the following accompanying drawings.

BRIEF DESCRIPTION OF THE DRAWINGS

Drawings explained here are used to provide further understanding of the present disclosure, which constitute a portion of the present disclosure. The schematic embodiments and description of the present disclosure are only used for explaining the present disclosure, and do not constitute improper delimitations of the present disclosure. In the drawings.

DESCRIPTION OF THE INVENTION

Figure 1:
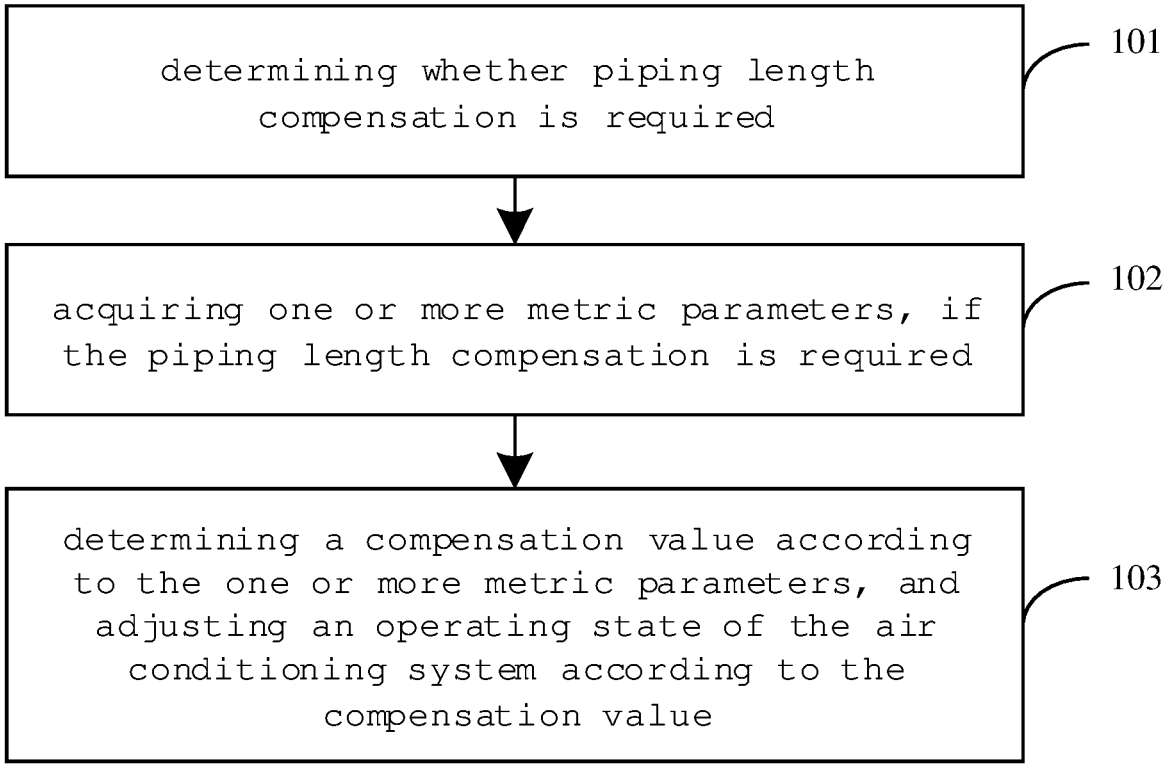
FIG. 1 illustrates a flow diagram of a control method of an air conditioning system according to some embodiments of the present disclosure.

The technical solutions in the embodiments of the present disclosure will be clearly and completely described below with reference to the accompanying drawings in the embodiments of the present disclosure. Obviously, the described embodiments are only a part of the embodiments of the present disclosure instead of all of them. The following descriptions on at least one illustrative embodiment are actually illustrative, but shall not set any limitation on the present disclosure and its application or utilization. All other embodiments that are obtainable to those skilled in the art based on the embodiments of the present disclosure without any creative effort are comprised in the protection scope of the present disclosure.

Unless otherwise illustrated, respective arrangements, mathematic expressions and values of the components and steps illustrated in these embodiments do not limit the scope of the present disclosure. Meanwhile, it shall be understood that in order to facilitate description, the respective parts shown in the drawings are not drawn in sizes according to actual proportional relations. Techniques, methods and devices that have already been known to ordinary technicians in the art may not be discussed here in detail, but under suitable circumstances, the techniques, methods and devices shall be deemed as parts of the granted description. In the embodiments shown and discussed here, any specific value shall be interpreted as only illustrative, instead of limitative. Hence, other embodiments of the illustrative embodiments may have different values. It shall be noted that similar marks and letters represent similar items in the following figures, so once a certain item is defined in one figure, no further discussion on it is required in the following figures.

The inventor of the present disclosure finds that the following problems exist in the related technology described above: the length of the piping causes pressure loss, which further influences performance indexes such as refrigerating capacity, energy efficiency ratio, heating capacity and heating performance coefficient of the multi-connected air conditioner system, so that the control effect of the related technology is not accurate enough. In view of this, the present disclosure provides a control technical solution of an air conditioning system, which can compensate for the length of the piping, so as to improve the accuracy of the control effect.

The piping between the indoor units and the outdoor unit has large on-way resistance and local resistance, which will cause the suction pressure of the compressor to be reduced during refrigeration, and the condensation temperature of the compressor to be reduced during heating, and further cause the refrigerating capacity or the heating capacity of the multi-connected air conditioning system to be reduced, and the energy efficiency ratio to be reduced.

The length of the piping is directly related to the pressure loss, which in turn influences a plurality of performance indexes of the multi-connected air conditioning system. Therefore, the length of the piping between the indoor units and the outdoor unit of the multi-connected air conditioning system should not be too large; otherwise, it will not only affect the cooling and heating performance of the system, but also affect the safety, adjustability, comfort and operating efficiency of the system. And the longer the piping length of the indoor unit, the higher the inlet pipe temperature, and the value of the inlet pipe temperature is far larger than the system low pressure; that is, the longer the piping, the larger the overheat, resulting in a decrease in indoor capacity.

The above problems can be solved through the following embodiments.

FIG. 1 illustrates a flow diagram of a control method of an air conditioning system according to some embodiments of the present disclosure.

The method comprises the following steps: step 101, determining whether piping length compensation is required; step 102, acquiring one or more metric parameters, if the piping length compensation is required; step 103: determining a compensation value according to the one or more metric parameters, and adjusting the operating state of the air conditioning system according to the compensation value.

The control method of the present disclosure is applied to a multi-connected air conditioning system, wherein the multi-connected air conditioning system comprises an outdoor unit and a plurality of indoor units, and the indoor units are connected with the outdoor unit through piping; wherein the outdoor unit comprises an inverter compressor.

The method firstly determines whether the piping length influences the operation capacity of the air conditioning system, and compensates the piping length of the system according to the detected metric parameter under the condition that the operation capacity of the system is insufficient, so as to improve the operation capacity of the whole machine, and meet the comfort. The method can adaptively compensate the influence of the piping length on the system without detecting the piping length.

Figure 2:
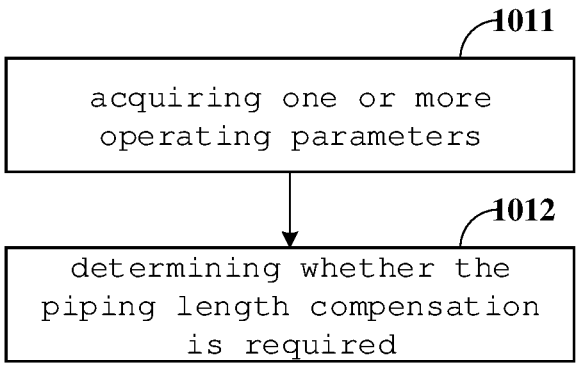
FIG. 2 illustrates a flow diagram of some embodiments of the step 101 in the FIG. 1.

FIG. 2 illustrates a flow diagram of some embodiments of the step 101 in the FIG. 1.

In some embodiments, the determining whether piping length compensation is required comprises: step 1011, acquiring one or more operating parameters, the one or more operating parameters comprising at least one of indoor unit operating parameters, outdoor unit operating parameters and environmental parameters; and step 1012, determining whether the piping length compensation is required according to the one or more operating parameters.

By compensating the piping length of the air conditioning system, the insufficient system operation capacity caused by the piping length can be compensated, so that the overall operation capacity of the air conditioning system is improved, and the comfort is met. Further, before compensation, it is necessary to determine whether the system needs compensation. The present disclosure uses indoor unit operating parameters, outdoor unit operating parameters, environmental parameters, etc. to make a determination, and can accurately determine the current operating capacity of the system, thereby accurately controlling the air conditioning system.

In some embodiments, when the air conditioning system is a multi-connected air conditioning system, the indoor unit operating parameters comprise a ratio of the number of indoor units that are turned on.

In the existing multi-connected air conditioning system, the number of indoor units that are turned on is determined by a communication command feedback signal; that is, the indoor units in the standby state send a standby command to the outdoor unit, and the indoor units in the operation state send an operation command, so as to count the number of the indoor units that are turned on and in operation. The total number of the indoor units in the system is fixed, so that the ratio of the number of the indoor units that are turned on is easy to calculate.

In some embodiments, the outdoor unit of the air conditioning system comprises a compressor, and the outdoor unit operating parameters comprise a continuous operating time of the compressor since it is started.

After the compressor is started, a timer can be arranged in the system to record the continuous operating time of the compressor; when the compressor is turned off, the record of the timer is cleared, and timing is restarted when the compressor is started next time.

In some embodiments, the environmental parameters comprise a temperature difference value between an outdoor temperature value and a temperature value set by an indoor unit.

The outdoor temperature value can be obtained by a temperature detection device provided on the outdoor unit. The indoor units can feed back the set temperature value to the control device, so that the control device can easily obtain the temperature value set by each indoor unit.

In some embodiments, the determining whether piping length compensation is required according to the one or more operating parameters comprises determining that the piping length compensation is required under at least one of the following conditions: the one or more operating parameters comprise a ratio of the number of indoor units that are turned on, which is smaller than a preset ratio threshold; the one or more operating parameters comprise a continuous operating time of a compressor since it is started, which is greater than a preset time threshold; or the one or more operating parameters comprise a temperature difference value between an outdoor temperature value and a temperature value set by an indoor unit, which is smaller than a preset temperature difference threshold.

By compensating the piping length of the air conditioning system, the insufficient system operation capacity caused by the piping length can be compensated, so that the overall operation capacity of the air conditioning system is improved, and the comfort is met. Furthermore, the system can carry out comprehensive evaluation according to the ratio of the number of indoor units that are turned on and the temperature difference value to obtain a partial load of the system.

Figure 3:
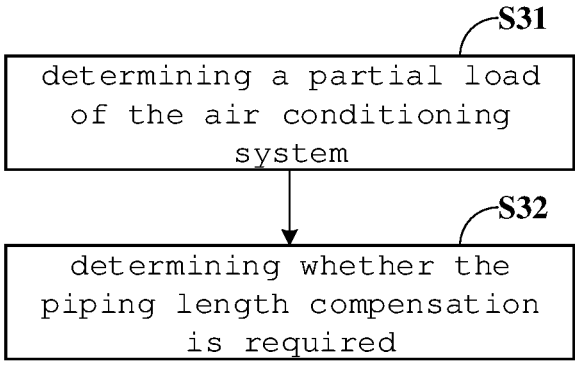
FIG. 3 illustrates a flow diagram of some embodiments of the step 1012 in the FIG. 2.

FIG. 3 illustrates a flow diagram of some embodiments of the step 1012 in the FIG. 2.

In some embodiments, the determining whether piping length compensation is required according to the one or more operating parameters comprises: step S31, determining a partial load of the air conditioning system according to the ratio of the indoor units that are turned on and the temperature difference value; and step S32, determining that the piping length compensation is required under the condition that the partial load is smaller than a load threshold and the continuous operating time is larger than the time threshold.

In some embodiments, when the indoor units are fully turned on and the temperature difference value is maximum, the partial load is a maximum value of 100%; if the partial load is 75%, it may be because that the indoor units are partially turned on or the temperature difference value is small. In addition, it is necessary to combine the continuous operating time of the compressor, so as to more accurately determine whether the system has insufficient operation capacity.

In some embodiments, it may be set that when the partial load is less than 80% and the continuous operating time of the compressor is not less than 3 minutes, it is determined that the system operation capacity is insufficient and piping length compensation is required.

Figure 4:
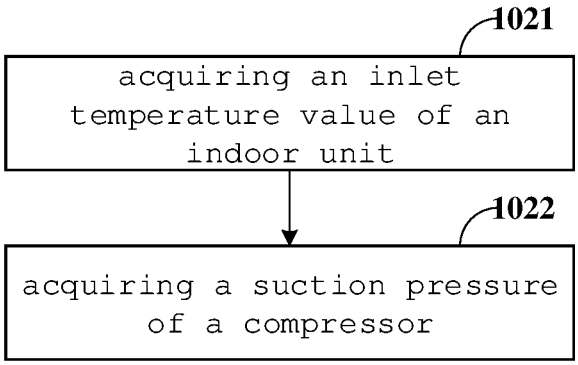
FIG. 4 illustrates a flow diagram of some embodiments of the step 102 in the FIG. 1.

FIG. 4 illustrates a flow diagram of some embodiments of the step 102 in the FIG. 1.

In some embodiments, when the operating state is an operating frequency of the compressor, the acquiring one or more metric parameters comprises: step 1021, acquiring an inlet temperature value of an indoor unit; and step 1022, acquiring a suction pressure of the compressor.

By compensating the piping length of the air conditioning system, the insufficient system operation capacity caused by the piping length can be compensated, so that the overall operation capacity of the air conditioning system is improved, and the comfort is met. Furthermore, the amount of piping length compensation needs to be accurately evaluated, and insufficient or excessive compensation cannot achieve the optimal effect. The present disclosure comprehensively considers two factors of the inlet temperature value of the indoor units and the suction pressure of the compressor as metric parameters, and can better determine the compensation amount required by the system.

Figure 5:
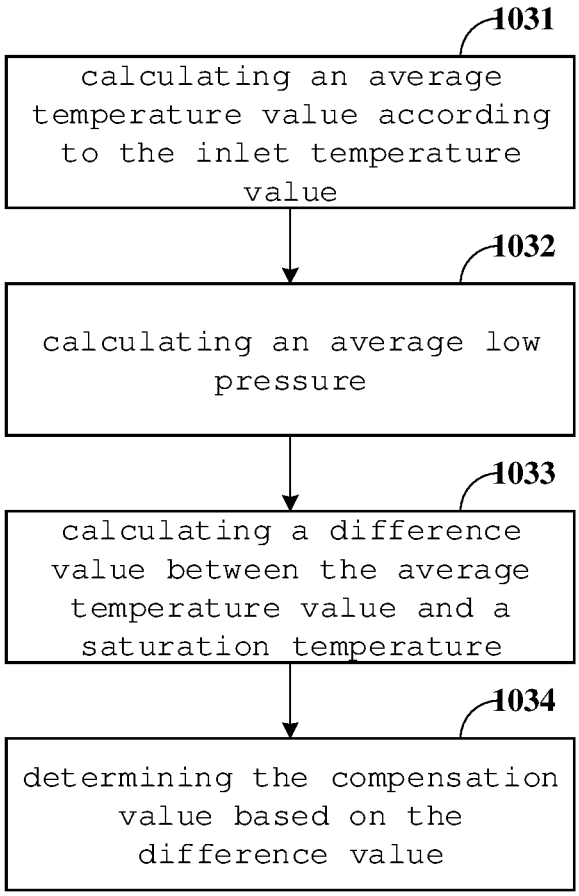
FIG. 5 illustrates a flow diagram of some embodiments of the step 103 in the FIG. 1.

FIG. 5 illustrates a flow diagram of some embodiments of the step 103 in the FIG. 1.

In some embodiments, the determining the compensation value according to the one or more metric parameters comprises: step 1031, calculating an average temperature value according to the inlet temperature value, when the number of indoor units that are turned on is multiple; step 1032, calculating an average low pressure according to the suction pressure of the compressor; step 1033, calculating a difference value between the average temperature value and a saturation temperature corresponding to the average low pressure; and step 1034, determining the compensation value based on the difference value.

Multiple indoor units in the system may have different inlet temperature values, so it is necessary to calculate the average value of multiple detected data before further processing can be made. The average low pressure is an average value obtained by multiple measurements, and can also be an average value obtained by multiple-point measurements.

In some embodiments, the larger the difference value, the larger an absolute value of the compensation value, a sign of the compensation value is determined according to an operation mode of an air conditioner.

In some embodiments, the compensation value is a negative value, if the operation mode of the air conditioner is a cooling mode; or, the compensation value is a positive value, if the operation mode of the air conditioner is a heating mode.

In some embodiments, the relationship between the compensation value K and the difference value A may be:

$$K = \begin{cases} 0, & \Delta < 6 \\ \pm 1, & \Delta \in [6, 10) \\ \pm 2, & \Delta \geq 10 \end{cases}$$

Wherein, "–" is the value during refrigeration, and "+" is the value during heating. It should be noted that the specific values such as 6 and 10 may be different in different systems; the specific values are related to the length and the shape of the piping, that is, related to the resistance loss, and the specific values can be determined through experimental effects.

It is easy to understand that when the compensation value K is assigned a value 0, it means that no compensation is performed; when the value of K is not 0, compensation is performed by changing the operating frequency of the compressor.

The larger the absolute value of K, the higher the compressor output frequency. Taking refrigeration as an example, in actual operation, when the system is determined to need compensation, the system enters a low-pressure comfort condition, namely there is a target low-pressure operation range; the compressors of the system are gradually added according to this target until the low-pressure operation range is satisfied; now K pulls this range down so that the compressor will operate at a higher frequency. Heating is high-pressure comfort regulation, and K is pulled up.

In the above embodiment, it is first determined whether the piping length influences the operation capacity of the air conditioning system, and the piping length of the system is compensated according to the detected metric parameters under the condition that the operation capacity of the system is insufficient, so as to improve the operation capacity of the whole machine, and meet the comfort. The present disclosure can adaptively compensate the influence of the piping length on the system without detecting the piping length.

Figure 6:
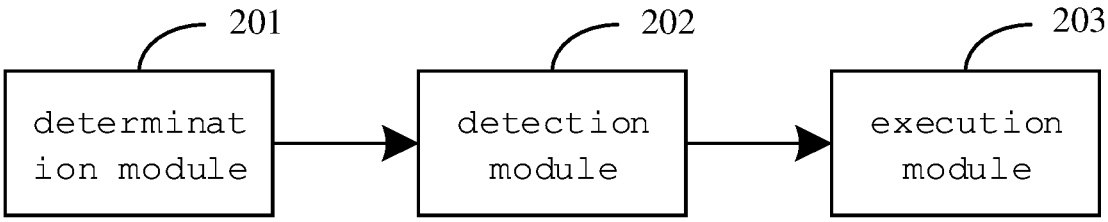
FIG. 6 illustrates a block diagram of a control device of an air conditioning system according to some embodiments of the present disclosure.

FIG. 6 illustrates a block diagram of a control device of an air conditioning system according to some embodiments of the present disclosure.

Referring to FIG. 6, the device comprises a determination module 201, a detection module 202 and an execution module 203.

The determination module 201 is used for determining whether the piping length compensation is required; the detection module 202 is used for acquiring one or more metric parameters when the piping length compensation needs to be performed; and the execution module 203 is used for determining a compensation value according to the one or more metric parameters and adjusting the operating state of the air conditioning system according to the compensation value.

In some embodiments, the determination module 201 is used for: acquiring the one or more operating parameters, the one or more operating parameters comprising at least one of indoor unit operating parameters, outdoor unit operating parameters and environmental parameters; and determining whether the piping length compensation is required according to the one or more operating parameters.

In some embodiments, when the air conditioning system is a multi-connected air conditioning system, the indoor unit operating parameters comprise a ratio of the number of indoor units that are turned on.

In some embodiments, the outdoor unit of the air conditioning system comprises a compressor, and the outdoor unit operating parameters comprise a continuous operating time of the compressor since it is started.

In some embodiments, the environmental parameters comprise a temperature difference value between an outdoor temperature value and a temperature value set by an indoor unit.

In some embodiments, the determining whether the piping length compensation is required according to the one or more operating parameters comprises determining that the piping length compensation is required under at least one of the following conditions: the one or more operating parameters comprise a ratio of the number of indoor units that are turned on, which is smaller than a preset ratio threshold; the one or more operating parameters comprise a continuous operating time of a compressor since it is started, which is greater than a preset time threshold; or the one or more operating parameters comprise a temperature difference value between an outdoor temperature value and a temperature value set by an indoor unit, which is smaller than a preset temperature difference threshold.

In some embodiments, the determining whether piping length compensation is required according to the one or more operating parameters comprises: determining a partial load of the air conditioning system according to the ratio of the indoor units that are turned on and the temperature difference value; and determining that the piping length compensation is required under the condition that the partial load is smaller than a load threshold and the continuous operating time is larger than the time threshold.

In some embodiments, when the operating state is an operating frequency of the compressor, the detection module 202 is used for: acquiring an inlet temperature value of an indoor unit; and acquiring a suction pressure of the compressor.

In some embodiments, when determining the compensation value according to the one or more metric parameters, the execution module 203 is used for: when the number of indoor units that are turned on is multiple, calculating an average temperature value according to the inlet temperature value; calculating an average low pressure according to the suction pressure of the compressor; calculating a difference value between the average temperature value and a saturation temperature corresponding to the average low pressure; and determining the compensation value based on the difference value.

In some embodiments, when determining the compensation value based on the difference value, the execution module 203 is used for: determining that an absolute value of the compensation value is larger, if the difference value is larger and determining whether the compensation value is positive or negative according to the operation mode of the air conditioner.

In some embodiments, if the operation mode of the air conditioner is a cooling mode, the compensation value is a negative value; or, if the operation mode of the air conditioner is a heating mode, the compensation value is a positive value.

With regard to the device in the above embodiment, the specific manner in which each module performs an operation has been described in detail in the embodiment related to the method, and will not be described in detail here.

The present application also provides the following embodiment.

An air conditioning system, the air conditioning system is a multi-connected air conditioning system, comprising: the control device of the air conditioning system in any of the above embodiments.

In some embodiments, the air conditioning system comprises a control device, the control device at least comprising the following three modules: a determination module for determining whether piping length compensation is required; a detection module for acquiring one or more metric parameters when the piping length compensation is required; and an execution module for determining a compensation value according to the one or more metric parameters and adjusting an operating state of the air conditioning system according to the compensation value.

In some embodiments, the determining whether piping length compensation is required comprises: acquiring the one or more operating parameters, the one or more operating parameters comprising at least one of indoor unit operating parameters, outdoor unit operating parameters and environmental parameters; and determining whether the piping length compensation is required according to the one or more operating parameters.

In some embodiments, when the air conditioning system is a multi-connected air conditioning system, the indoor unit operating parameters comprise a ratio of the number of indoor units that are turned on.

In some embodiments, the outdoor unit of the air conditioning system comprises a compressor, and the outdoor unit operating parameters comprise a continuous operating time of the compressor since it is started.

In some embodiments, the environmental parameters comprise a temperature difference value between an outdoor temperature value and a temperature value set by an indoor unit.

In some embodiments, the determining whether the piping length compensation is required according to the one or more operating parameters comprises determining that the piping length compensation is required under at least one of the following conditions: the one or more operating parameters comprise a ratio of the number of indoor units that are turned on, which is smaller than a preset ratio threshold; the one or more operating parameters comprise a continuous operating time of a compressor since it is started, which is greater than a preset time threshold; or the one or more operating parameters comprise a temperature difference value between an outdoor temperature value and a temperature value set by an indoor unit, which is smaller than a preset temperature difference threshold.

In some embodiments, the determining whether piping length compensation is required according to the one or more operating parameters comprises: determining a partial load of the air conditioning system according to the ratio of the indoor units that are turned on and the temperature difference value; and determining that the piping length compensation is required under the condition that the partial load is smaller than a load threshold and the continuous operating time is larger than the time threshold.

In some embodiments, when the operating state is an operating frequency of the compressor, the acquiring the one or more metric parameters comprises: acquiring an inlet temperature value of an indoor unit; and acquiring a suction pressure of the compressor.

In some embodiments, the determining the compensation value according to the one or more metric parameters comprises: when the number of indoor units that are turned on is multiple, calculating an average temperature value according to the inlet temperature value; calculating an average low pressure according to the suction pressure of the compressor; calculating a difference value between the average temperature value and a saturation temperature corresponding to the average low pressure; and determining the compensation value based on the difference value.

In some embodiments, the larger the difference value, the larger an absolute value of the compensation value, a sign of the compensation value is determined according to an operation mode of an air conditioner.

In some embodiments, the compensation value is a negative value if the operation mode of the air conditioner is a cooling mode; or, the compensation value is a positive value, if the operation mode of the air conditioner is a heating mode.

The present application also provides the following embodiment.

A control device of an air conditioning system, comprising: a processor; a memory for storing processor-executable instructions. Wherein the processor is configured to perform the control method of the air conditioning system in any of the above embodiments.

In some embodiments, the processor determines whether the piping length compensation is required; one or more metric parameters are acquired, if the piping length compensation is required; and a compensation value is determined according to the one or more metric parameters, and an operating state of the air conditioning system is adjusted according to the compensation value.

In some embodiments, the determining whether piping length compensation is required comprises: acquiring one or more operating parameters, the one or more operating parameters comprising at least one of indoor unit operating parameters, outdoor unit operating parameters and environmental parameters; and determining whether the piping length compensation is required according to the one or more operating parameters.

In some embodiments, when the air conditioning system is a multi-connected air conditioning system, the indoor unit operating parameters comprise a ratio of the number of indoor units that are turned on.

In some embodiments, the outdoor unit of the air conditioning system comprises a compressor, and the outdoor unit operating parameters comprise a continuous operating time of the compressor since it is started.

In some embodiments, the environmental parameters comprise a temperature difference value between an outdoor temperature value and a temperature value set by an indoor unit.

In some embodiments, the determining whether piping length compensation is required according to the one or more operating parameters comprises determining that the piping length compensation is required under at least one of the following conditions: the one or more operating parameters comprise a ratio of the number of indoor units that are turned on, which is smaller than a preset ratio threshold; the one or more operating parameters comprise a continuous operating time of a compressor since it is started, which is greater than a preset time threshold; or the one or more operating parameters comprise a temperature difference value between an outdoor temperature value and a temperature value set by an indoor unit, which is smaller than a preset temperature difference threshold.

In some embodiments, the determining whether piping length compensation is required according to the one or more operating parameters comprises: determining a partial load of the air conditioning system according to the ratio of the indoor units that are turned on and the temperature difference value; and determining that the piping length compensation is required under the condition that the partial load is smaller than a load threshold and the continuous operating time is larger than the time threshold.

In some embodiments, when the operating state is an operating frequency of the compressor, the acquiring the one or more metric parameter comprises: acquiring an inlet temperature value of an indoor unit; and acquiring a suction pressure of the compressor.

In some embodiments, the determining a compensation value according to the one or more metric parameter comprises: when the number of indoor units that are turned on is multiple, calculating an average temperature value according to the inlet temperature value; calculating an average low pressure according to the suction pressure of the compressor; calculating a difference value between the average temperature value and a saturation temperature corresponding to the average low pressure; and determining the compensation value based on the difference value.

In some embodiments, the larger the difference value, the larger an absolute value of the compensation value, a sign of the compensation value is determined according to an operation mode of an air conditioner.

In some embodiments, the compensation value is a negative value, if the operation mode of the air conditioner is a cooling mode; or, the compensation value is a positive value, if the operation mode of the air conditioner is a heating mode.

It is understood that the same or similar parts in the above embodiments may be mutually referred to, and the contents not described in detail in some embodiments may refer to the same or similar contents in other embodiments.

It should be noted that, in the description of the present application, the terms "first", "second", etc. are used for descriptive purposes only and are not to be construed as indicating or implying relative importance. Further, in the description of the present application, the meaning of "a plurality of" means at least two unless otherwise specified.

Any process or method descriptions in flow diagrams or otherwise described herein may be understood as representing modules, segments, or portions of code which comprise one or more executable instructions for implementing specific logical functions or steps of the process, and the scope of the preferred embodiments of the present application comprises additional implementations in which functions may be executed out of order from that shown or discussed, comprising substantially concurrently or in reverse order, depending on the functions involved, as would be understood by those skilled in the art to which embodiments of the present application pertain.

It should be understood that each part of the present application may be implemented in hardware, software, firmware, or a combination thereof. In the above embodiments, various steps or methods may be implemented with software or firmware stored in a memory and executed by a suitable instruction execution system. For example, if implemented in hardware, as in another embodiment, it can be implemented by any one or combination of the following technologies, which are well known in the art: a discrete logic circuit having a logic gate circuit for implementing a logic function on a data signal, an application specific integrated circuit having an appropriate combinational logic gate circuit, a Programmable Gate Array (PGPGA), a Field Programmable Gate Array (FPGA), or the like.

It will be understood by those ordinary skilled in the art that all or part of the steps carried out by The control method of the above embodiments may be implemented by a program instructing relevant hardware, all the programs may be stored in a non-transitory computer readable storage medium, and the program, when executed, comprises one or a combination of the steps of the method embodiments.

In addition, functional units in the embodiments of the present application may be integrated into one processing module, or each unit may exist alone physically, or two or more units are integrated into one module. The integrated module can be realized in the form of hardware, and can also be realized in the form of a software functional module. The integrated module, if implemented in the form of a software functional module and sold or used as a separate product, may also be stored in a non-transitory computer readable storage medium.

The non-transitory storage medium mentioned above may be a read-only memory, a magnetic or optical disk, etc.

In the descriptions of the present specification, the terms "one embodiment", "some embodiments", "an example", "a specific example", or "some examples" or the like mean that specific features, structures, materials or characteristics described in combination with the embodiment or example are comprised in at least one embodiment or example of the present disclosure. In the description, demonstrative expressions of said terms may not refer to the same example or demonstration. Moreover, the specific features, structures, materials or characteristics as described may be combined in a suitable manner in any one or more examples or demonstrations.

Although embodiments of the present application have been shown and described above, it should be understood that the above embodiments are exemplary and should not be construed as limiting the present application, and those ordinary skilled in the art may change, modify, replace and deform the above embodiments within the scope of the present application.

What is claimed is:

1. A control method of an air conditioning system, comprising:

determining that piping length compensation is required;

acquiring one or more metric parameters, in response to the piping length compensation being required; and determining a compensation value according to the one or more metric parameters and adjusting an operating state of the air conditioning system according to the compensation value;

wherein:

the determining that the piping length compensation is required comprises:

acquiring one or more operating parameters, the one or more operating parameters comprising at least one of indoor unit operating parameters, outdoor unit operating parameters or environmental parameters; and determining that the piping length compensation is required according to the one or more operating parameters, wherein, the one or more operating parameters comprise a ratio of a number of indoor units that are turned on, a continuous operating time of a compressor since it is started, and a temperature difference value between an outdoor temperature value and a temperature value set by an indoor unit, the determining that the piping length compensation is required according to the one or more operating parameters comprises:

determining a partial load of the air conditioning system according to the ratio of the indoor units that are turned on and the temperature difference value; and determining that the piping length compensation is required in response to that the partial load being smaller than a load threshold and the continuous operating time being larger than the time threshold.

2. A control device of an air conditioning system, comprising:

a processor; and a memory for storing processor-executable instructions;

wherein the processor is configured to perform the control method of the air conditioning system according to claim 1.

3. A non-transitory computer readable storage medium having stored thereon a computer program which, when executed by a processor, implements the control method of the air conditioning system according to claim 1.

4. A control method of an air conditioning system, comprising:

determining that piping length compensation is required;

acquiring one or more metric parameters, in response to the piping length compensation being required, wherein the metric parameters comprise an inlet temperature value of an indoor unit and a suction pressure of a compressor; and determining a compensation value according to the one or more metric parameters and controlling an operating state of the air conditioning system according to the compensation value;

wherein the determining the compensation value according to the one or more metric parameters comprises:

calculating an average temperature value according to inlet temperature values of multiple indoor units that are turned on;

calculating an average low pressure according to the suction pressure of the compressor;

calculating a difference value between the average temperature value and a saturation temperature corresponding to the average low pressure; and determining the compensation value based on the difference value.

5. The control method of claim 4, wherein the determining that piping length compensation is required comprises:

acquiring one or more operating parameters, the one or more operating parameters comprising at least one of indoor unit operating parameters, outdoor unit operating parameters or environmental parameters; and determining whether the piping length compensation is required according to the one or more operating parameters.

6. The control method of claim 5, wherein when the air conditioning system is a multi-connected air conditioning system, the indoor unit operating parameters comprise a ratio of a number of indoor units that are turned on.

7. The control method of claim 5, wherein an outdoor unit of the air conditioning system comprises a compressor, and the outdoor unit operating parameters comprise a continuous operating time of the compressor since it is started.

8. The control method of claim 5, wherein the environmental parameters comprise a temperature difference value between an outdoor temperature value and a temperature value set by an indoor unit.

9. The control method of claim 5, wherein the determining whether piping length compensation is required according to the one or more operating parameters comprises:

determining that the piping length compensation is required under at least one of the following conditions:

the one or more operating parameters comprise a ratio of a number of indoor units that are turned on, which is smaller than a preset ratio threshold;

the one or more operating parameters comprise a continuous operating time of a compressor since it is started, which is greater than a preset time threshold;

or the one or more operating parameters comprise a temperature difference value between an outdoor temperature value and a temperature value set by an indoor unit, which is smaller than a preset temperature difference threshold.

10. The control method of claim 4, wherein the larger the difference value, the larger an absolute value of the compensation value, a sign of the compensation value is determined according to an operation mode of an air conditioner.

11. The control method of claim 10, wherein:

the compensation value is a negative value, if the operation mode of the air conditioner is a cooling mode; or the compensation value is a positive value, if the operation mode of the air conditioner is a heating mode.

12. A control device of an air conditioning system, comprising:

a processor; and a memory for storing processor-executable instructions;

wherein the processor is configured to perform the control method of the air conditioning system according to claim 4.

13. A non-transitory computer readable storage medium having stored thereon a computer program which, when executed by a processor, implements the control method of the air conditioning system according to claim 4.

14. A control device of an air conditioning system, comprising:

a determination module for determining that piping length compensation is required;

a detection module for acquiring one or more metric parameters in response to the piping length compensation being required; and an execution module for determining a compensation value according to the one or more metric parameters and controlling an operating state of the air conditioning system according to the compensation value, wherein the execution module is configured to calculate an average temperature value according to inlet temperature values of multiple indoor units that are turned on, calculate an average low pressure according to the suction pressure of the compressor, calculate a difference value between the average temperature value and a saturation temperature corresponding to the average low pressure and determine the compensation value based on the difference value.

15. An air conditioning system, the air conditioning system being a multi-connected air conditioning system, comprising:

the control device of the air conditioning system according to claim 14.

* * * * *